United States Patent [19]

Trost

[11] Patent Number: 4,512,373

[45] Date of Patent: Apr. 23, 1985

[54] FEEDING AND GUIDING MEANS FOR TRIAXIAL FABRIC FORMING MACHINE

[75] Inventor: Wayne C. Trost, Rockford, Ill.

[73] Assignee: Barber-Colman Company, Rockford, Ill.

[21] Appl. No.: 492,791

[22] Filed: May 9, 1983

[51] Int. Cl.[3] ..... D03D 41/00; D03D 49/16

[52] U.S. Cl. ..... 139/11; 139/DIG. 1; 139/101; 66/125 R; 242/131

[58] Field of Search ..... 139/1 R, DIG. 1, 11, 139/13, 101, 103, 104, 17; 66/125 R; 242/131, 131.1

[56] References Cited

U.S. PATENT DOCUMENTS

| | | | |
|---|---|---|---|
| 1,522,377 | 1/1925 | Longvall | 242/131 X |
| 3,432,117 | 3/1969 | Leger | 242/131 |
| 3,589,146 | 6/1971 | Schmidt | 66/125 R |
| 3,805,556 | 4/1974 | Planck, Jr. et al. | 66/125 R |
| 4,015,637 | 4/1977 | Halton et al. | 139/DIG. 1 |
| 4,036,262 | 7/1977 | Darsie et al. | 139/DIG. 1 |
| 4,105,052 | 8/1978 | Trost et al. | 139/101 |

FOREIGN PATENT DOCUMENTS

| | | | |
|---|---|---|---|
| 2833360 | 2/1980 | Fed. Rep. of Germany | 242/131 |
| 1284898 | 1/1962 | France | 139/13 R |

*Primary Examiner*—James Kee Chi

*Attorney, Agent, or Firm*—Ratner & Prestia

[57] ABSTRACT

Improved supply yarn tensioning and path guide means comprising the provision of spindles and guides for supplying warp yarns from individual packages, together with tensioning means for controlling the tension in each individually supplied warp yarn strand, preferably by controlling the rolling resistance of a package on a spindle provided therefor, which resistance is overcome by pulling the yarn strand off the package. In a further embodiment, an improved elliptical guide means is provided for guiding the warp yarn path changes.

6 Claims, 5 Drawing Figures

FEEDING AND GUIDING MEANS FOR TRIAXIAL FABRIC FORMING MACHINE

BACKGROUND OF THE INVENTION

This invention pertains to a machine for fabricating triaxial fabric, and more particularly to improvements in such a machine for the feeding under controlled tension of individual yarn ends and the guiding of yarn from the feeding means to the weaving mechanism under controlled tension and with minimum mechanical handling.

Triaxial fabric forming machines are disclosed, for example, in U.S. Pat. Nos. 4,015,637—Halton et al and 4,031,922—Trost et al, both of which are now of common assignment with the present application and both of which are incorporated herein by reference. Those patents both disclose vertically oriented machines with a rotating creel on a vertical axis carrying multi-end beams of warp supply yarn.

The multiplicity of yarn ends from these beams is guided inwardly and down to form two planar arrays aligned at the point of weaving along the fell line of the woven fabric. An individual yarn end, in successive stages of the triaxial weaving sequence, traverses from one end of an array to the other and then is transferred to the other array where it does the same thing. In such machines, the mechanism for maintaining uniform tension of each of the yarn ends is necessarily complex, in part because of the variation in individual yarn path lengths as the creel rotates, and in part because multiple ends are fed from each beam.

Various types of tension means, such as that identified by reference numeral 104 in FIG. 5 of U.S. Pat. No. 4,015,637, have been used. A specific mechanism for guiding the warp yarn ends as they traverse the weaving array is seen, for example, as track 40 in FIG. 2 of U.S. Pat. No. 4,036,262 along which travels yarn guiding divider plates 41 (as seen in FIG. 11). Divider plates (or guides 41) and track 40 together deflect the yarn path of each yarn end to provide an essentially constant length yarn path for that yarn end as it traverses about the array.

Still another form of warp yarn path compensator and guide is the closed path tubular guide 173, seen in FIG. 12 of U.S. Pat. No. 4,036,262.

Still other warp length compensating means for a triaxial weaving machine are disclosed in U.S. Pat. No. 4,170,249.

Notwithstanding these prior efforts to devise tensioning means and yarn path length compensators in a triaxial weaving machine, there remains a need for still further improvements with respect to these aspects in triaxial weaving machines. This need has become more apparent in the course of the recent development of methods and means for forming triaxial fabrics of high modulus fibers, such as graphite fibers. In conventional weaving with such fibers, efforts have been made to control the tension of individual yarn ends by virtue of the rolling friction of a yarn package on a supply spindle. No such tension controlling mechanism has heretofore been adapted in a triaxial weaving machine.

Moreover, informing fabrics from high modulus fibers, such as graphite, (beams) are undesirable because of the tendency of such high modulus fibers to break filaments or otherwise lose strength as they are wound onto a multi-end package.

It is also known that in certain circular knitting machines, rotating creels are provided with individual yarn packages mounted thereon. In knitting, however, unlike weaving, little or no yarn tension is desirable and for the most part yarn is fed from the individual packages on such creels with a minimum of tension.

There remains a need, therefore, for improved tensioning and yarn path length compensation means for triaxial fabric forming machines, and particularly for vertically oriented triaxial fabric forming machines with rotating creels.

More particularly, there remains a need for such improvements for use in the weaving of high modulus fibers.

It is, therefore, the general object of the present invention to provide such improved tensioning means, and to provide such means which more effectively control the tension in individual yarn ends of a triaxial fabric forming machine notwithstanding path length changes of an individual yarn end, and which permits the use of single end yarn packages.

BRIEF DESCRIPTION OF THE INVENTION

Briefly, the present invention comprises certain improvements in a triaxial fabric forming machine, wherein a rotating warp yarn supply creel includes a plurality of spindles, adapted for mounting individual or multiple single end or multiple end yarn packages, together with suitable guiding means by which individual yarn ends are taken from each of the packages on the spindles and guided into a cylindrical array, from which the individual yarn ends are fed to the weaving mechanism. More importantly, means are provided for controlling the tension in each individual yarn end in the course of its travel from the individual spindles to the weaving mechanism. Preferably, this is accomplished by the provision on the spindle of a means for permitting a yarn package mounted thereon to rotate at a preselected minimum torque adapted to control tension in a yarn as it is pulled from the package.

Although not yet incorporated in the preferred form of the present invention, a further aspect of the present invention is an elliptical guide means, disposed between the weaving mechanism and the cylindrical array forming guides of the warp yarn supply creel. This guide assists in forming two planar sheet arrays of warp yarns, while permitting the individual warp yarns to traverse successive positions in the arrays as the warp supply creel rotates.

BRIEF DESCRIPTION OF THE DRAWINGS

For a better understanding of the present invention, reference is made to the detailed description thereof which follows, taken in conjunction with the drawings, in which.

DETAILED DESCRIPTION OF THE INVENTION

Figure 1:
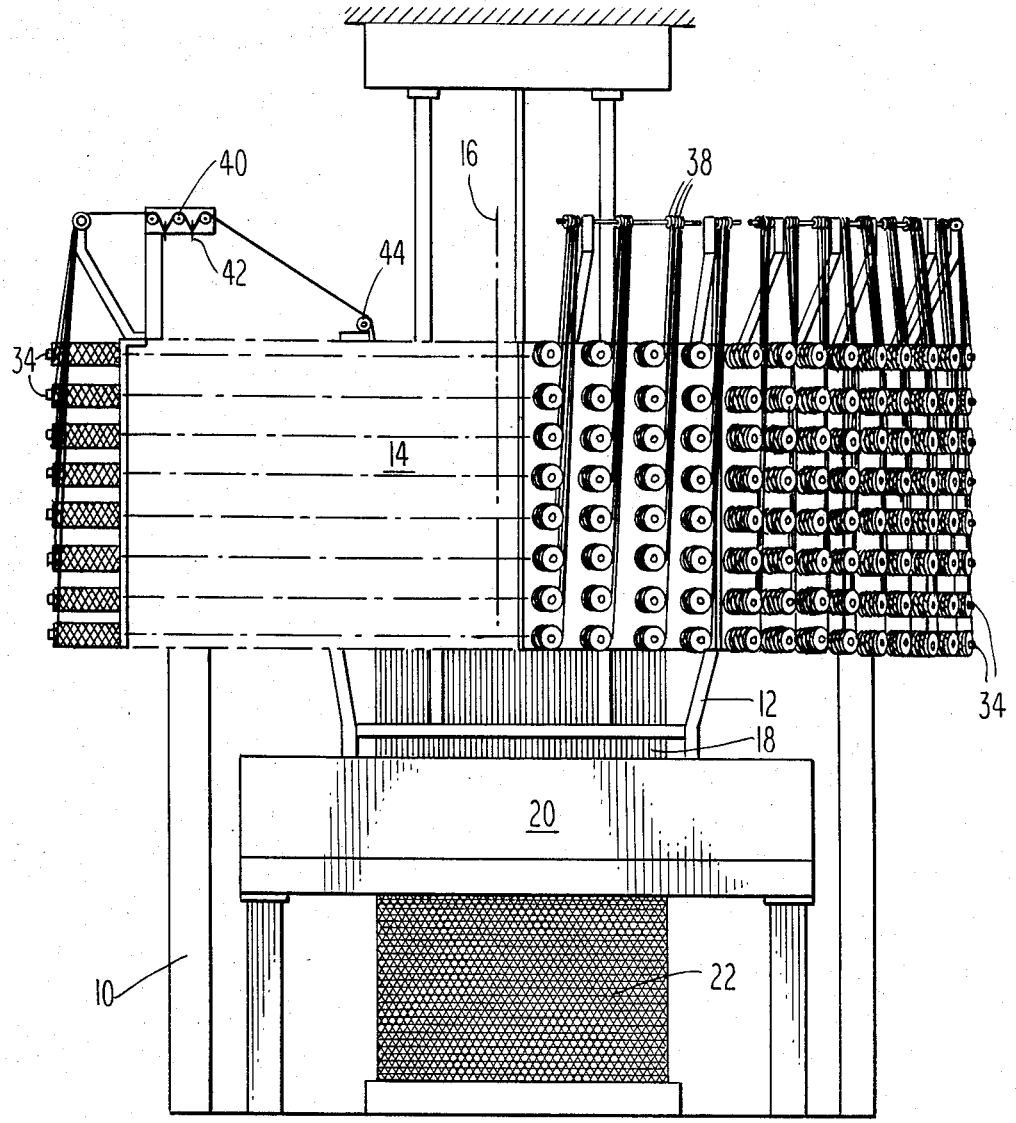
FIG. 1 is an schematic elevation view of the preferred embodiment of a triaxial fabric forming machine, in which is incorporated the improvements of the present invention.
Figure 2:
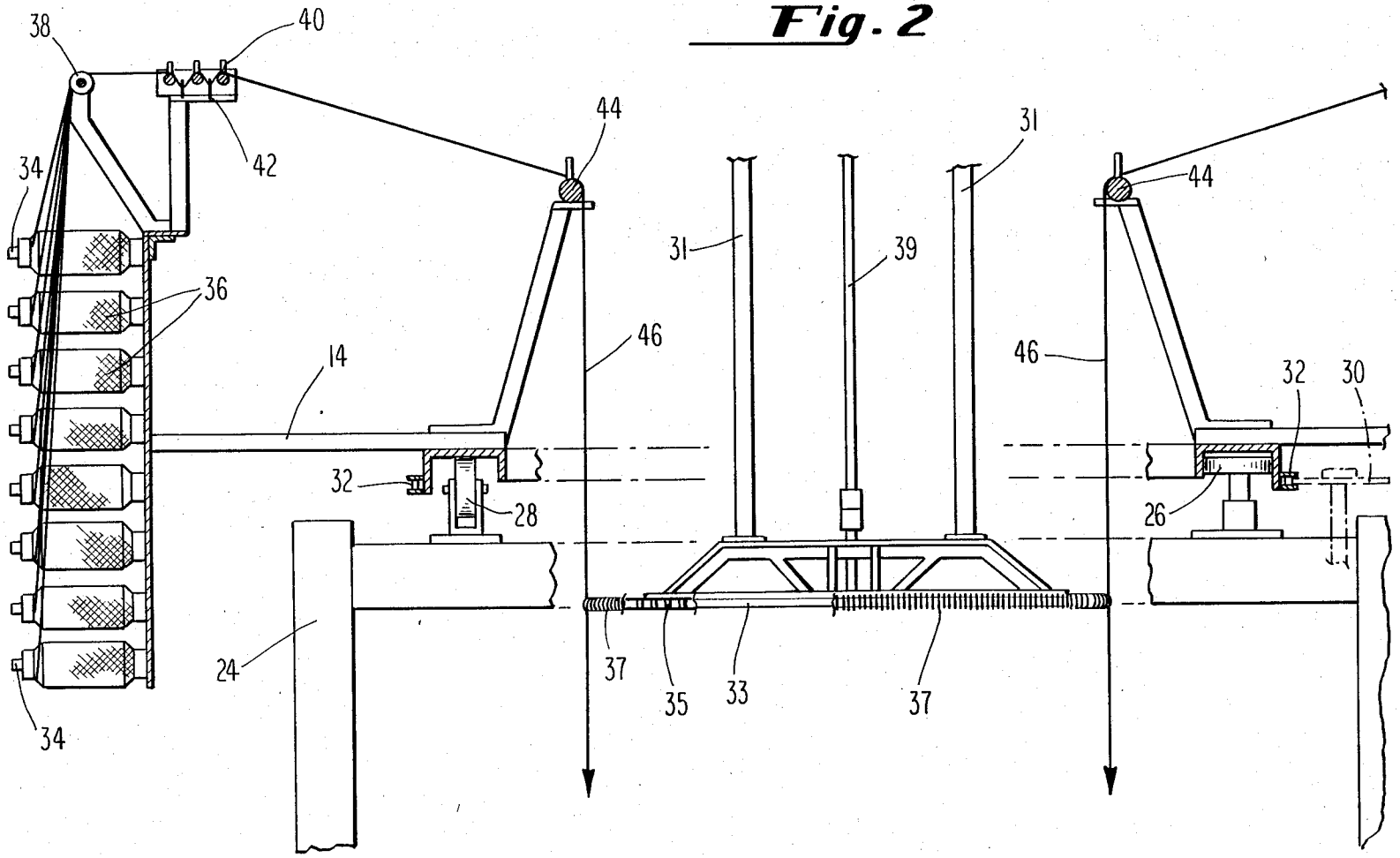
FIG. 2 is an elevation view in cross section of a portion of the machine shown in FIG. 1.
Figure 3:
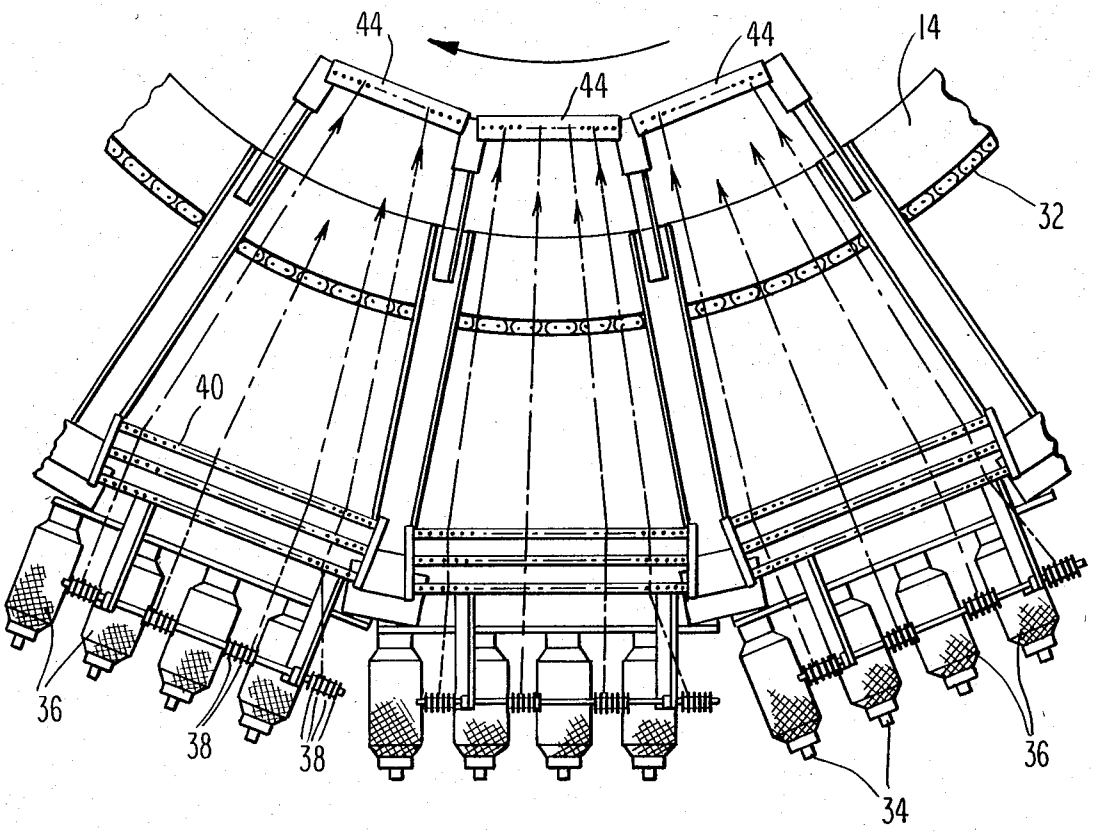
FIG. 3 is a partial plan view of the machine shown in FIGS. 1 and 2.

The preferred embodiment of the triaxial fabric forming machine warp yarn supply and tensioning means of the present invention is illustrated in FIGS. 1–3. This yarn supply and tensioning means is incorporated in an otherwise conventional fabric forming machine, as described and illustrated, for example, in U.S. Pat. Nos. 4,015,637 and 4,031,922. As shown in FIGS. 1–3, the machine of this invention includes stand 10, and warp yarn supply creel 14, mounted and adapted for rotation about a vertical axis 16. Also as in prior art machines, a plurality of warp yarns supplied from creel 14 is guided into two planar arrays 18 as the warp yarns enter an axially central warp yarn gathering and weaving position 20, from which woven triaxial fabric 22 exits downwardly to a take-up roll, not shown.

As seen more specifically in FIGS. 2 and 3, creel 14 rests on upward extension 24 of stand 10 and more specifically on a plurality of horizontally rotating guides 26 and vertically rotating load supporting rollers 28, one of each of which is shown in the diagrammatic sectional illustration of FIG. 2. Guides 26 and rollers 28 are positioned in alternate radial locations around axis 16 of creel 14.

Rotational motion is imparted to creel 14 by engagement of a driven sprocket wheel 30, shown in phantom in FIG. 2, engaging a top sprocket chain 32 associated with creel 14. The individual warp yarn supply and tensioning means of the present invention comprises a plurality of spindles 34 disposed in vertically aligned (or nearly aligned) groups about the periphery of creel 14 at symmetrically distributed radial positions.

Figure 5:
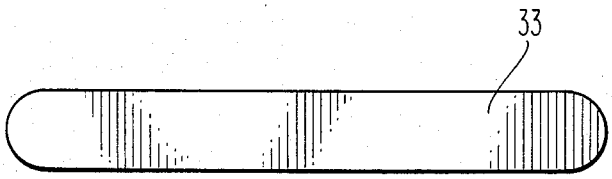
FIG. 5 is a schematic plan view of the warp yarn traversing guide means of FIG. 2.

Suspended from above by supports 12 (in FIG. 1), framework 31 carries an elongated elliptical track 33 (the shape of which, in plan view, is better seen in FIG. 5) with an endless sprocket chain 35, the individual links of which are attached traversing warp yarn guide blocks 37 (like guide blocks 41 of FIG. 11 in U.S. Pat. No. 4,036,262). Sprocket chain 35 is driven about track 33 by power shaft 39 and an associated sprocket wheel (not shown) in timed relation with the rotation of creel 14. In this manner individual warp yarns carried by guide blocks 37 are formed into two facing planar arrays and are caused to traverse the successive positions of those arrays as creel 14 rotates.

In the operation of a machine as shown in FIGS. 1–3, a plurality of single end yarn packages 36 are mounted on spindles 34, each yarn package 36 including a central cylindrical surface adapted to mate with a spindle 34 in a manner to permit package 36 to rotate on spindle 34 upon application of a preselected minimum torque. As yarn is pulled from yarn package 36, it rotates package 36 on spindle 34 by the application of a torque above the preselected minimum and in doing so necessarily applies at least a correspondingly preselected minimum tension to the yarn strand. Thus, tension is controlled in each individual yarn strand, which is a critical factor in delivering that strand to the weaving position at relatively constant tension, notwithstanding several directional changes and yarn path length changes occurring in the strand during its passage from the supply package to the weaving mechanism and during the traverse of a package about axis 16. Generally, this tension is necessarily determined by the characteristic drag or friction allowable in the mating of the inner cylindrical mounting surface of each yarn package 36 and the outer mounting surface of each spindle 34 in the preferred form of the present invention. However, other individual yarn end tensioning means may also be provided to control tension in each individual yarn strand, in accordance with the present invention.

It will be readily appreciated that the provision of individual single end yarn packages 36 and the delivery of warp yarn therefrom to the weaving mechanism facilitates close control of individual yarn tension, and allows independent yarn withdrawal from one package without affecting another. This is much more difficult in prior art machines incorporating multi-end beams as the warp yarn supply.

As will also be apparent, the provision of single end yarn package warp supply and delivery means, together with the individual tensioning means preferably provided by the control of the rolling tension of packages 36 on spindles 34, also inherently compensates for any yarn path length changes of an individual yarn strand, as an individual yarn package supplying that strand traverses circumferentially about the periphery of the machine during the rotation of creel 14 about axis 16. In this manner, complex mechanisms for compensating for such path length changes in prior art machines are rendered unnecessary.

For the downstream control and delivery of each individual yarn end from a package 36 to weaving position 20, a plurality of guide means is provided. Specifically, these include groups of individual warp yarn receiving guides 38, disposed at radial positions about creel 14 intermediate the radial positions of the vertically aligned groups of spindles 34, so that each guide 38 is adapted to receive a single yarn end from a respective package 36 mounted on a respective spindle 34 in a straight path from guide 38. Each individual yarn strand then passes over a second set of guides 40, with which is associated a drop wire indicating mechanism 42, adapted to indicate a break in the yarn strand at any individual warp yarn position. From guides 40, the individual warp yarn supply strands pass over a third set of guides 44 from which the paths of the individual warp yarn strands are deflected downwardly into an essentially cylindrical array about axis 16, as indicated by arrows 46.

By the intervention of moving guide block 37, as previously described, this cylindrical array of warp supply yarn strands is converted in the course of its downward movement to be presented ultimately as two planar arrays of linearly oriented warp yarns facing one another. These arrays are fed to two corresponding arrays of warp yarn heddles, the heddles in each of the arrays also being linearly oriented and opposed to each other, the linear orientation of the heddles and warp yarns in these arrays corresponding to the "fell" line of the weaving mechanism, which is perpendicular to axis 16 of creel 14. Thus, throughout the travel of an individual warp yarn strand from its supply package 36 to the weaving heddle which it ultimately engages, its tension is controlled, notwithstanding changes in path length by the individual warp yarn tensioner associated with the package 36, preferably that provided by the drag resisting rolling movement of package 36 on spindle 34.

Figure 4:
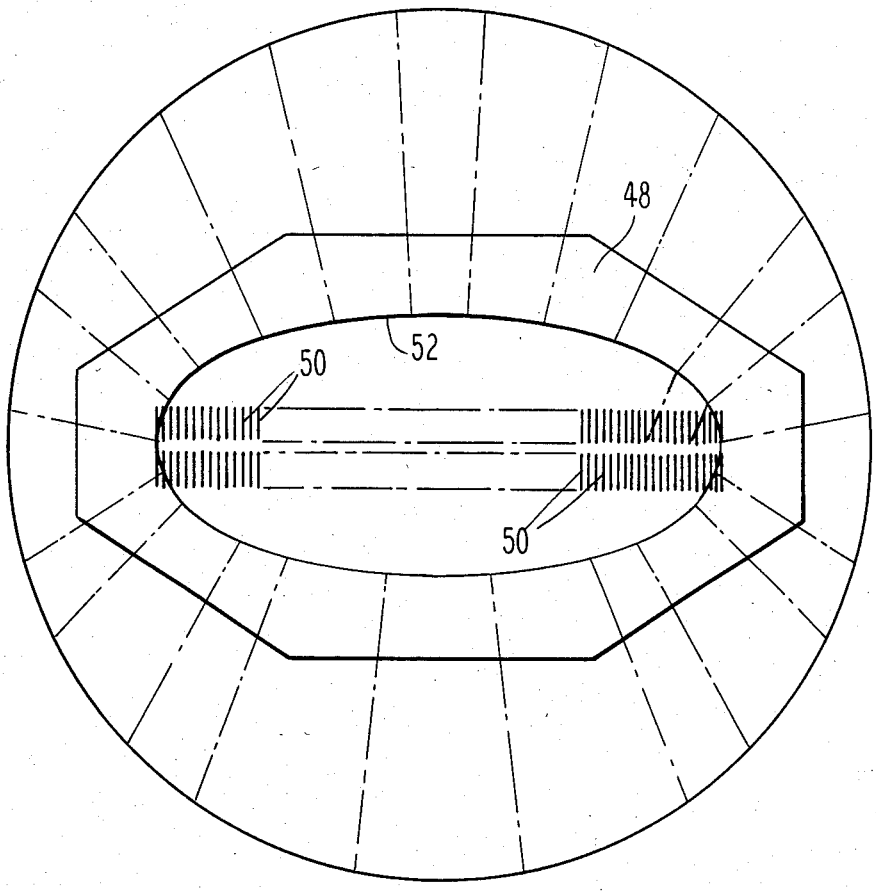
FIG. 4 is a schematic plan view of an alternative warp yarn guide means for a triaxial fabric forming machine in accordance with one aspect of the present invention.

A further yarn path guide means in accordance with another aspect of the present invention is shown in FIG. 4. This warp yarn guide means may be incorporated in a machine otherwise comprising the individual warp yarn supply and tensioning means of the present invention. More specifically, the warp yarn path guide shown in FIG. 4 comprise an elliptical guide 48 disposed between guides 44 and opposed linearly oriented array heddles 50 at the yarn gathering and weaving position. Guide 48 assists in converting the cylindrical array of warp yarns exiting guides 44 into two planar arrays, for purposes of presentation to heddles 50. Specifically, guide 48 includes a low friction, inner surface facing axis 16 so as to provide minimum frictional resistance to movement of each individual yarn strand axially or downwardly over yarn guide 48 and also to provide minimum frictional resistance to lateral movement of each individual yarn strand, that is movement about the inner periphery of the elliptical yarn guide 48 as the respective yarn packages and associated yarn strands traverse a circular path upon rotation of creel 14.

The minor axis of elliptical guide 48 is selected to provide minimal deflection of the yarn path of an individual yarn passing from a yarn package to a respective weaving heddle at the middle of each of the planar arrays of heddles 50, while the major axis of elliptical guide 48 is selected to be equal in length to the lengths of each of the planar arrays of heddles 50 so as to provide minimal deflection of the yarn path of a yarn strand passing from a yarn package 36 to a respective heddle 50 at the end of the linear arrays thereof. In this manner, the path length of a yarn strand passing from a package to a respective heddle remains essentially constant notwithstanding the radial position of that package and the linear position of its respective heddle. Moreover, the continuous, smooth characteristic of the inner surface 52 of elliptical guide 48 permits the transverse movement of each individual yarn strand, so that a mechanism associated with the weaving heddles to guide an individual yarn strand along the elongated path of the planar arrays of yarn strands at the weaving position is unnecessary. Instead, this lateral movement of each individual yarn strand is provided by the corresponding rotation of the yarn strand supply package, specifically the individual yarn package 36 associated with creel 14, and the lateral indexing movement of the corresponding heddles in the planar array of heddles in the weaving machine.

While this invention has been described with respect to particular embodiments thereof, the appended claims are not intended to be limited thereto. Instead, the appended claims are intended to be construed so as to encompass not only the embodiments of the invention described and illustrated, but also to such other variants of the invention as may be devised by those skilled in the art, without departing from the true spirit and scope thereof.

I claim:

1. In a triaxial fabric forming machine comprising a warp yarn supply creel mounted and adapted to rotate about an axis, and means for guiding individual warp yarn strands from said creel through a variable path length to an axially central warp yarn gathering and weaving position, said variable path length dependent on the rotation of said creel about said axis, the improvement comprising individual warp yarn supply and tensioning means mounted on said creel, said supply means comprising a plurality of spindles, each of which is adapted to support a yarn package, and a plurality of guide means, said plurality of guide means including a plurality of individual receiving guides, each of which is adapted to receive a single yarn end in a straight path from one of said spindles, said plurality of guide means further including a circular yarn array forming means for guiding a plurality of individual yarn ends received from said individual receiving guides into an essentially cylindrical array concentric with and parallel to the axis of said circular creel, said tensioning means comprising a means for controlling the tension separately for each yarn supplied by a yarn package located on each one of said spindles and for maintaining relatively constant tension in each yarn irrespective of the variable path length of said yarn during rotation of said creel about said axis.

2. An improved triaxial fabric forming machine, as recited in claim 1, wherein said tensioning means comprises a means for permitting a yarn package mounted on each of said spindles to rotate at a preselected minimum torque adapted to control the tension in a yarn end and the rate of yarn delivery of that yarn end as it is pulled therefrom through said variable path length by the weaving action of said machine.

3. An improved triaxial fabric forming machine, as recited in claim 1, wherein said creel is mounted for rotation about a vertical axis, said spindles being disposed in a plurality of vertically aligned groups, said groups being symmetrically distributed around the outer periphery of said creel extending radially outwardly therefrom, said individual receiving guides being disposed in a plurality of groups, each of said guide groups being located above said spindles and at a radial position on said creel between an adjacent pair of vertically aligned spindle groups.

4. An improved triaxial fabric forming machine, as recited in claim 2, wherein said creel is mounted for rotation about a vertical axis, said spindles being disposed in a plurality of vertically aligned groups, said groups being symmetrically distributed around the outer periphery of said creel, said individual receiving guides being disposed in a plurality of groups, each of said guide groups being located above said spindles and at a radial position on said creel between an adjacent pair of vertically aligned spindle groups.

5. An improved triaxial fabric forming machine, as recited in claim 1, further including, at said warp yarn gathering and weaving position, two arrays of warp yarn heddles, each of said arrays being linearly oriented and opposed to the other of said arrays along a fell line perpendicular to the axis of said creel, and further including, between said warp gathering and weaving position, and said circular yarn array forming means, a yarn path guide means, said yarn path guide means comprising an elliptical guide, the major axis of said elliptical guide being parallel to said fell line and equal in length to the length of each of said heddle arrays so as to provide minimal deflection to a yarn path extending from a heddle at the end of said arrays back to the nearest point on said circular yarn array forming means, said elliptical guide having a sufficiently smooth guide surface on the axis side thereof to minimize the resistance of that surface to lateral and axial movement of a yarn in contact therewith.

6. In a triaxial fabric forming machine comprising a warp yarn supply creel mounted and adapted to rotate about an axis, and means for guiding individual warp yarn strands from said creel to an axially central warp yarn gathering and weaving position, at which is disposed two arrays of warp yarn heddles, each of said arrays being linearly oriented and opposed to the other of said arrays along a fell line perpendicular to the axis of said creel, the improvement comprising, between said warp gathering and weaving position and said circular yarn array forming means, a yarn path guide means, said yarn path guide means comprising an elliptical guide, the major axis of said elliptical guide being parallel to said fell line and being equal in length to the length of each of said heddle arrays to provide minimum deflection to a yarn path extending from a heddle at the end of said arrays back to the nearest point on said circular yarn array forming means, said elliptical guide having a sufficiently smooth guide surface on the axis side thereof to minimize the resistance of that surface to lateral and axial movement of a yarn in contact therewith.

* * * * *